US007155159B1

(12) United States Patent
Weinblatt et al.

(10) Patent No.: US 7,155,159 B1
(45) Date of Patent: Dec. 26, 2006

(54) AUDIENCE DETECTION

(75) Inventors: Lee S. Weinblatt, 465 Winthrop St., Teaneck, NJ (US) 07666; Thomas Langer, Teaneck, NJ (US)

(73) Assignee: Lee S. Weinblatt, Teaneck, NJ (US)

( * ) Notice: Subject to any disclaimer, the term of this patent is extended or adjusted under 35 U.S.C. 154(b) by 0 days.

(21) Appl. No.: 09/519,248

(22) Filed: Mar. 6, 2000

(51) Int. Cl.
*H04H 9/00* (2006.01)

(52) U.S. Cl. ..... 455/2.01; 725/18

(58) Field of Classification Search ..... 455/2.01, 455/67.11, 67.12, 226.1, 3.01, 3.02; 725/9, 725/10, 11, 14, 15, 16, 18; 340/500, 539.1, 340/539.11

See application file for complete search history.

(56) References Cited

U.S. PATENT DOCUMENTS 4,695,879 A 9/1987 Weinblatt
4,718,106 A * 1/1988 Weinblatt ..... 455/2.01
4,930,011 A * 5/1990 Kiewit ..... 725/10
4,955,070 A * 9/1990 Welsh et al. ..... 455/2.01
5,457,807 A * 10/1995 Weinblatt ..... 455/2.01
5,630,203 A 5/1997 Weinblatt
5,768,680 A * 6/1998 Thomas ..... 455/2.01
5,819,155 A * 10/1998 Worthy et al. ..... 455/2.01
5,839,050 A * 11/1998 Baehr et al. ..... 455/2.01
5,896,554 A * 4/1999 Itoh ..... 455/2.01
2002/0059218 A1* 5/2002 August et al. ..... 707/5

FOREIGN PATENT DOCUMENTS

JP 04151919 A 5/1992

* cited by examiner

*Primary Examiner*—Quochien B. Vuong
(74) *Attorney, Agent, or Firm*—Cohen, Pontani, Lieberman & Pavane

(57) ABSTRACT

An audience surveying technique for identifying individual members of an audience listening to and/or watching a program performed from a programming signal source. A stationary apparatus is operatively arranged at a reception location with a plurality of portable devices designed to be worn by the audience members. The stationary apparatus detects and stores a surveying code transmitted with the program, and it also periodically emits a trigger signal which causes the portable devices to respond by emitting a unique identification signal pre-stored in each one. The stationary apparatus also detects and stores the identification signals. By associating the detected surveying code with the detected identification signals it is possible to quickly, accurately and reliably identify the individual audience members tuned to a particular program.

30 Claims, 4 Drawing Sheets

AUDIENCE DETECTION

BACKGROUND OF THE INVENTION

This invention is directed to a surveying technique applied while an audience is listening and/or watching a program performed from a programming signal source by reproduction equipment and, more particularly, to a technique that identifies individual members of that audience.

When a program is broadcast, it is important for a number of reasons to obtain information about the audience. The "program" can be audio and/or video, commercial and/or non-commercial, and is obtained as a programming signal from a program signal source. The "broadcast" of the program can be over the airwaves, cable, satellite, or any other signal transmission medium. This term also applies to playback from recording media such as audio tape, video tape, DAT, CD-ROM, and semiconductor memory. An "audience" for such program reproduction is constituted of the persons who perceive the program. Thus, all the people who have perceived any part of the program are included in the audience, but those present so as to perceive the program at a given time are considered as forming the audience in attendance.

The program is "performed" by any means which result in some form of perception by human beings, the most common being video and audio. The "reproduction equipment" is any and all types of units to convert a signal into human perceptible form.

The audience can be described as being "tuned" to a program when the signal source is a TV or radio broadcast station. This term may be less commonly applied when the signal source is a tape recorder. However, for the sake of brevity and convenience, the word "tuned" is applied herein to all situations in which an audience member selects a particular program, whether it be by twisting a dial, operating a remote control, or popping a cassette into a tape recorder for playback.

Audience survey information has been obtained in the past by audience measurement and market research organizations for advertisers and broadcasters. For example, advertisers are interested in knowing the number of people exposed to their commercials. Also, broadcasters use statistics on audience size and type for setting their advertising rates.

It is of interest to survey an audience not only in terms of its number but also to obtain characteristics of its individual members. Thus, for example, advertisers wish to identify the audience members by economic and social categories. This is possible if individual members of the audience can be identified.

Prior art techniques for obtaining such information involve primarily the following approaches. With one approach, people within the range of the radio station or who receive a television channel (either over the air or by cable) are contacted by phone and interviewed regarding their listening habits. Each person is questioned about the programs which that individual watched and/or listened to during the previous, say twenty-four hours. However, this technique is suspect because it is subject to recall errors as well as possible bias introduced by the interviewer. For example, if a specific TV program is mentioned to the person being interviewed, the suggestion may elicit a positive response to a question regarding whether that program was watched even when it actually was not. Another approach involves keeping diaries by persons agreeing to act as test subjects. Diary entries are to be made manually throughout the day to keep track of what signal sources are being watched and/or listened to. The diaries are collected periodically and analyzed. However, this approach is prone to inaccuracies because the test subjects may fail to make entries due to forgetfulness or laziness, or wrong entries can be made due to tardiness in attending to this task. Thus, it can be readily seen that the phone-contact, recall-dependent approach described above is unsatisfactory because people may not accurately remember what they listened to at any particular time and, also, because of the potential problem of suggestive bias. The diary-based approach is likewise unsatisfactory because people may not cooperate and be as meticulous in making timely diary entries as required to obtain the desired record-keeping accuracy. The above-described approaches require a significant and time-consuming effort on the part of the test participants to respond to the phoned-in questions or to record their TV viewing and/or radio listening habits.

Partly automated systems have also been developed which require relatively less active participation by the audience members. U.S. Pat. No. 3,056,135 issued to Currey et al. describes automatically determining the listening habits of wave signal receiver users. It provides a record of the number and types of persons using a wave signal receiver by monitoring the operational conditions of the receiver and utilizing both strategically placed switches for counting the number of persons entering, leaving and within a particular area and it employs a photographic recorder for periodically recording the composition of the audience. A mailable magazine provides a record of both the audience composition and the receiver operation information for manual processing by a survey organization. Shortcomings of this approach include the slowness with which data can be acquired and, further, many audience members object to being identified from the photographic record.

U.S. Pat. No. 4,644,509 issued to Kiewit et al. discloses an ultrasonic, pulse-echo method and apparatus for determining the number of persons in the audience and the composition of the audience of a radio receiver and/or a television receiver. First and second reflected ultrasonic wave maps of the monitored area are collected, first without people and second with people who may be present in the monitored area. The first collected background defining map is subtracted from the second collected map to obtain a resulting map. The resulting map is processed to identify clusters having a minimum intensity. A cluster size of the thus identified clusters is utilized to identify clusters corresponding to people in an audience. While this arrangement is effective for counting viewing audience members, individual audience members cannot be identified.

U.S. Pat. No. 4,632,915 issued to Heller, III describes a system for identifying the presence of TV viewers where the viewer wears a headphone which remains activated to receive audio by transmitting an acknowledgment signal in response to periodic polls.

Other automated audience surveying techniques are known in which the test participants forming the audience need only play a passive role. For example, it is known to utilize a survey signal transmitted by a broadcast station in combination with a programming signal. As disclosed in U.S. Pat. No. 4,718,106 issued to the present inventor, the transmitted survey signal is detected by a receiver and reproduced by a speaker. The speaker produces pressure waves in the air that can be detected by a microphone, for example, and with a frequency that is in what is scientifically regarded as the audible range of human hearing. Such pressure waves, or signals, are referred to as acoustic. An acoustic signal is regarded as being audible, irrespective of whether it is actually heard by a person, as long as it can be produced by a conventional speaker and detected by a conventional microphone. The audible acoustic signal is detected by a microphone and associated circuitry embodied in a portable device worn by the test participants, and data on the incidence of occurrence and/or the time of occurrence of the acoustic signal, and the code it contains, are stored and analyzed therein.

Variations of this passive technique can be found in U.S. Pat. Nos. 5,457,807 and 5,630,203 both issued to the present inventor.

With the passive technique of the prior art, each portable device could be pre-programmed with the unique identification ("ID") of its wearer. This ID information is downloaded yo a central processing station with the detected codes stored in the portable device to provide not only audience measurement data but also information about the individual audience members.

Although such a portable-device-based approach has great potential, it has several shortcomings even when implemented with the latest integrated circuit technology. For example, the cost per unit is unacceptably high. Also, the devices are too heavy to be worn comfortably. Furthermore, such devices require a high capacity memory to store all the information needed to provide the desired survey information. Lastly, the battery life is inconveniently shortened by all the functions such a device would need to perform. Accordingly, until better technology exists to implement such devices without these shortcomings, another approach must be found.

A key point to keep in mind is that the test participants must be minimally inconvenienced to achieve their full cooperation in order to derive data that is accurate, reliable and complete. For example, if the portable device is too heavy, they may choose not to wear it. If the memory is often filled and must be frequently downloaded to enable the device to be used for storing current data, occasionally the download operation may be delayed to a later, more convenient time, thus missing out on data during that interval. Therefore, with currently available technology for implementing such a prior art portable device, the preferred level of cooperation may not be achieved.

SUMMARY OF THE INVENTION

One object of the present invention is to identify individual members of an audience.

Another object of the present invention is to increase the reliability and accuracy with which survey information involving audience members is obtained.

A further object of the present invention is to facilitate the collection of audience surveying information by gaining the cooperation of the test subjects and by improving the speed with which the results are made available.

Yet another object of the present invention is to collect audience surveying information, including information about the audience members, at reasonable cost.

These and other objects are attained in accordance with one aspect of the present invention directed to an apparatus for identifying members of an audience tuned to a program broadcast by a programming signal source. The apparatus includes stationary means having transmitter means for periodically emitting a query signal and positioned at a reception location with reproduction equipment to perform the program. A plurality of portable means are provided which are adapted to be carried by members of the audience, including first detecting means to detect the query signal and, responsive thereto, emit respective audience-member identification signals. The stationary means includes second detecting means to detect the identification signals.

Another aspect of the invention is directed to a method for identifying members of an audience tuned to a program broadcast by a programming signal source. Personal identification data is stored in a plurality of portable devices to be carried by members of the audience. A trigger signal is emitted periodically at a reception location. The identification data is transmitted from the portable devices of audience members in attendance at the reception location in response to the trigger signal, and the transmitted identification data is detected.

Another aspect of the invention is directed to apparatus for identifying members of an audience tuned to a program broadcast by a programming signal source. A plurality of portable means are adapted to be carried by members of the audience, and these include means to periodically emit respective audience-member identification signals. Stationary means are positioned at a reception location with reproduction equipment to perform the program. The stationary means include means to detect the identification signals.

Another aspect of the invention is directed to a method for identifying members of an audience tuned to a program broadcast by a programming signal source. Personal identification data is stored in a plurality of portable devices adapted to be carried by members of the audience. The identification data is periodically transmitted from the portable devices. The identification data from those of said portable devices that are carried by audience members in attendance at a reception location is detected.

DETAILED DESCRIPTION OF THE DRAWINGS

To conduct the survey, persons are selected by the surveying organization based on certain criteria. These criteria can be, for example, age, income, geographic location, sex, and level of education. The broadcasting organization and/or advertisers may require an analysis of their listeners which is broken down into one or more of these categories. The individuals who are approached to be test subjects are merely asked to participate in a test the details of which are not explained. Each person is told only that a requirement of the test is the wearing of a certain article of clothing. Additional information is preferably not supplied in order to avoid predisposing or prejudicing the individual test subject toward or away from the aims of the survey. For example, if the individuals were told that the survey relates to a radio survey, then this might result in more time and attention being paid to radio listening than would be normal for that person. Even worse would be the situation were the individual informed of the particular radio station involved in the survey. In order to avoid this problem, each individual is given a portable device to wear on a regular basis as an article of clothing. For example, such a portable device might be a watch for men or a bracelet for women.

Figure 1:
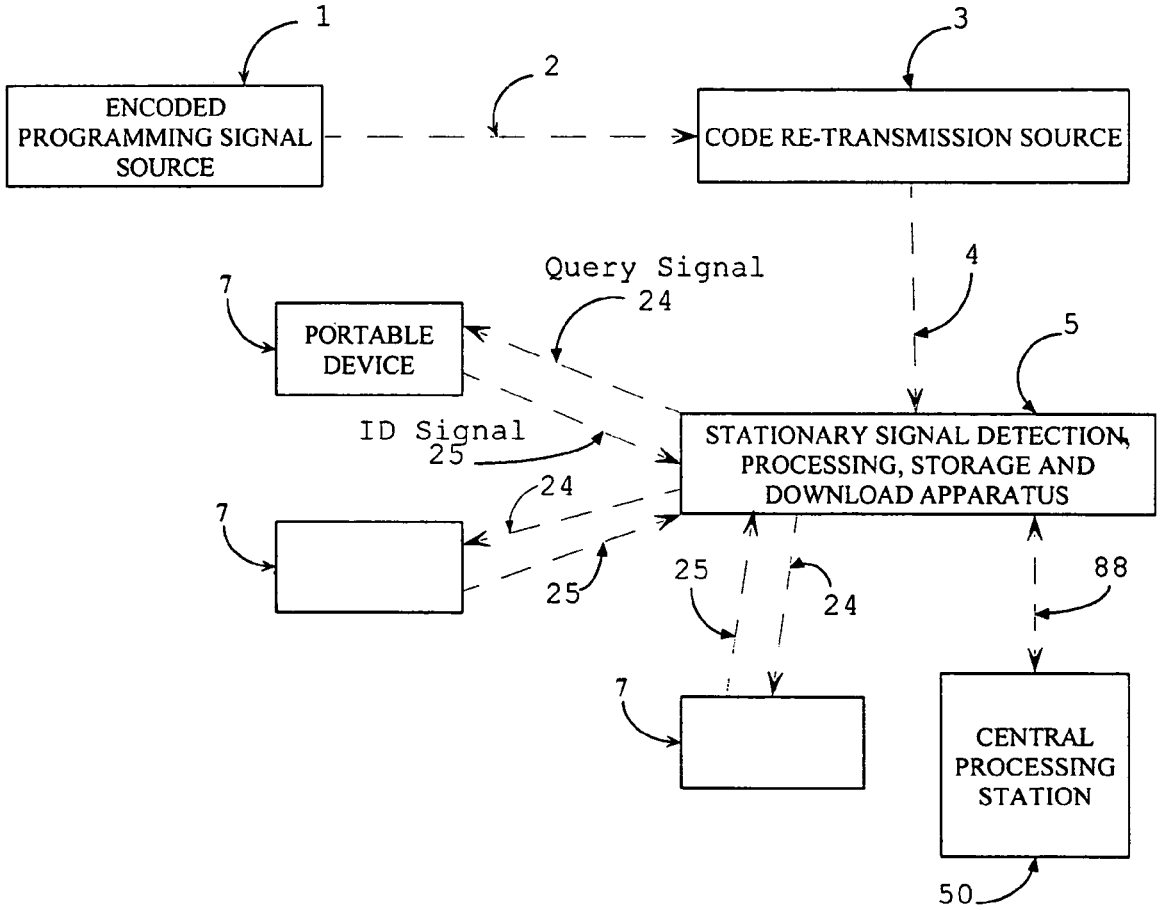
FIG. 1 is a schematic block diagram of the invention.

The present invention relies on four key components. As shown in FIG. 1, an encoded signal is generated by a program signal source 1, such as a TV broadcast station. Its output signal 2, which is a combination of a programming signal and a surveying code, is received by code retransmission source 3. Code retransmission source 3 can be capable of suitably reproducing the programming signal for video and/or audio performance. However, for audience surveying purposes, its key function is to detect the surveying code in the signal 2 received from programming signal source 1, and then to retransmit it in suitable fashion as output signal 4, as explained below. The code re-transmitted by code retransmission source 3 is detected and processed by stationary apparatus 5. A plurality of portable devices 7 operate cooperatively with stationary apparatus 5, in a manner described below. Details of these key components will now be provided, as follows.

A discussion of the source 1 of encoded program signals can be found in the above-mentioned patents of the present inventor, and such discussion found therein is hereby incorporated herein by reference.

Details of code retransmission source 3 can also be found in the above-mentioned patents issued to the present inventor, and such details found therein are hereby incorporated herein by reference. Suffice it to say that code retransmission source 3 is preferably a conventional component of a commercially available video and/or audio instrument, such as a television set. The conventional component of interest could be, for example, the TV's speaker. No retrofitting of the instrument would be required in order for such component to function as a code retransmission source. In such case, the output of code retransmission source 3 to stationary apparatus 5 would be in the form of an acoustic signal. See U.S. Pat. No. 4,718,106. However, it is also contemplated that some relatively minimal circuitry could be added to process and retransmit the code, as discussed in the above-mentioned patents of the present inventor. See U.S. Pat. Nos. 5,457,807 and 5,630,203.

The reception location that stationary apparatus 5 would typically be placed within is an area containing an instrument for reproducing the video and/or audio programming signal. The area would also be of sufficient size to accommodate an audience, preferably of several members. An example would be a room with a television set and seating capacity for several persons. Stationary apparatus 5 is a self-contained, relatively small and unobtrusive unit that can be placed on a surface in the room in such a way that communication between it and the portable devices worn by persons in the room is not blocked. To some extent, the restrictions on its placement depend on the nature of the communication signals, with radio signals providing a higher degree of flexibility than infrared signals, for example, The installation of stationary apparatus 5 is very simple in that it must be plugged into a wall outlet socket to receive power. Also, to enable data download, it is connected to a telephone line unless a cellular telephone device is used. Only a one time, fast, simple installation is involved that requires no retrofit of other apparatus in the house. This is in contrast to the prior art surveying equipment which does require a retrofitting operation. Apparatus 5 also improves the level of cooperation by the test participants because, for example, it overcomes any reluctance that prospective test participants would have to join the audience survey if it meant having holes drilled in their TV's, and the like.

Each of the persons cooperating as test participants is provided with a customized, portable device 7. All of the portable devices have identical circuitry. They are made unique, however, by virtue of the data stored therein. In particular, stored in each one is a unique ID signal which can be used to identify its wearer. Consequently, the devices cannot be interchanged among the various wearers but, rather, are specifically assigned to a particular person. Also, each portable device is provided with a unique delay period. The reason for this feature will become apparent from the description provided below.

Figure 2:
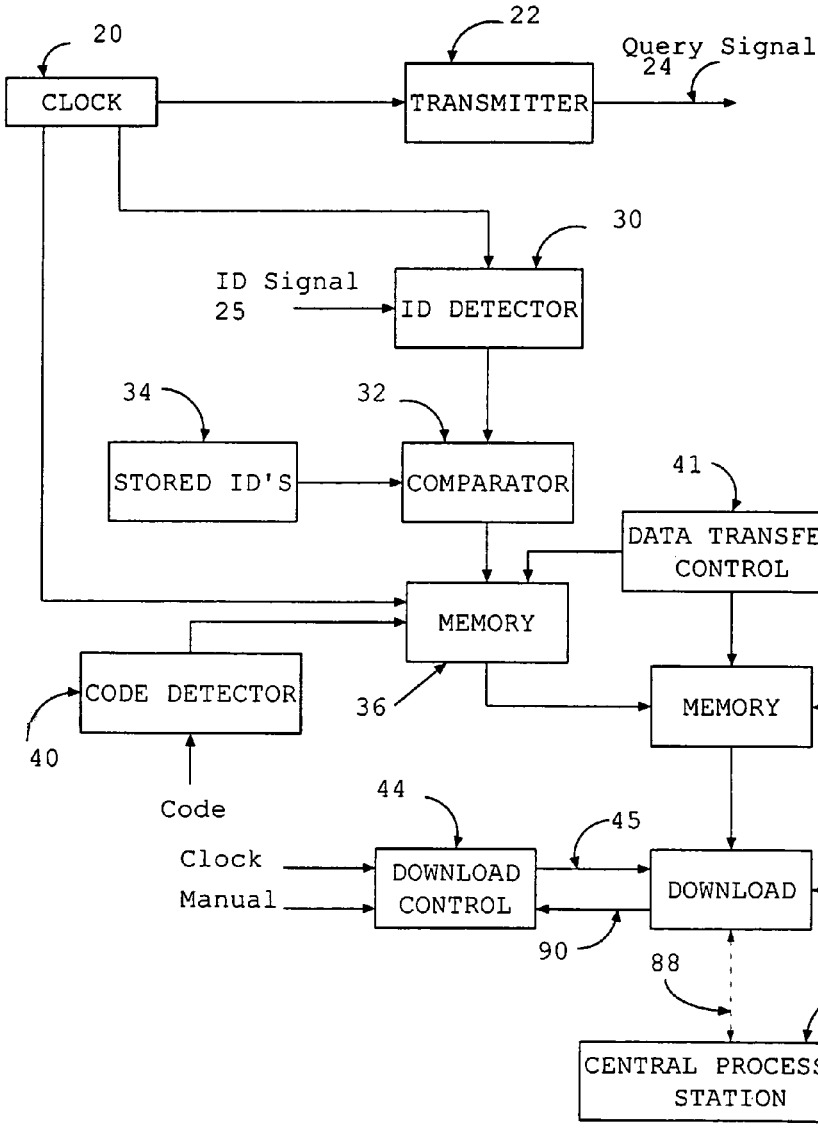
FIG. 2 shows details of the stationary apparatus.
Figure 3:
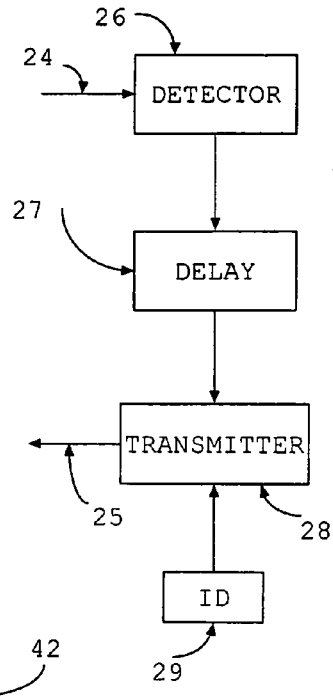
FIG. 3 shows details of the portable devices.
Figure 4:
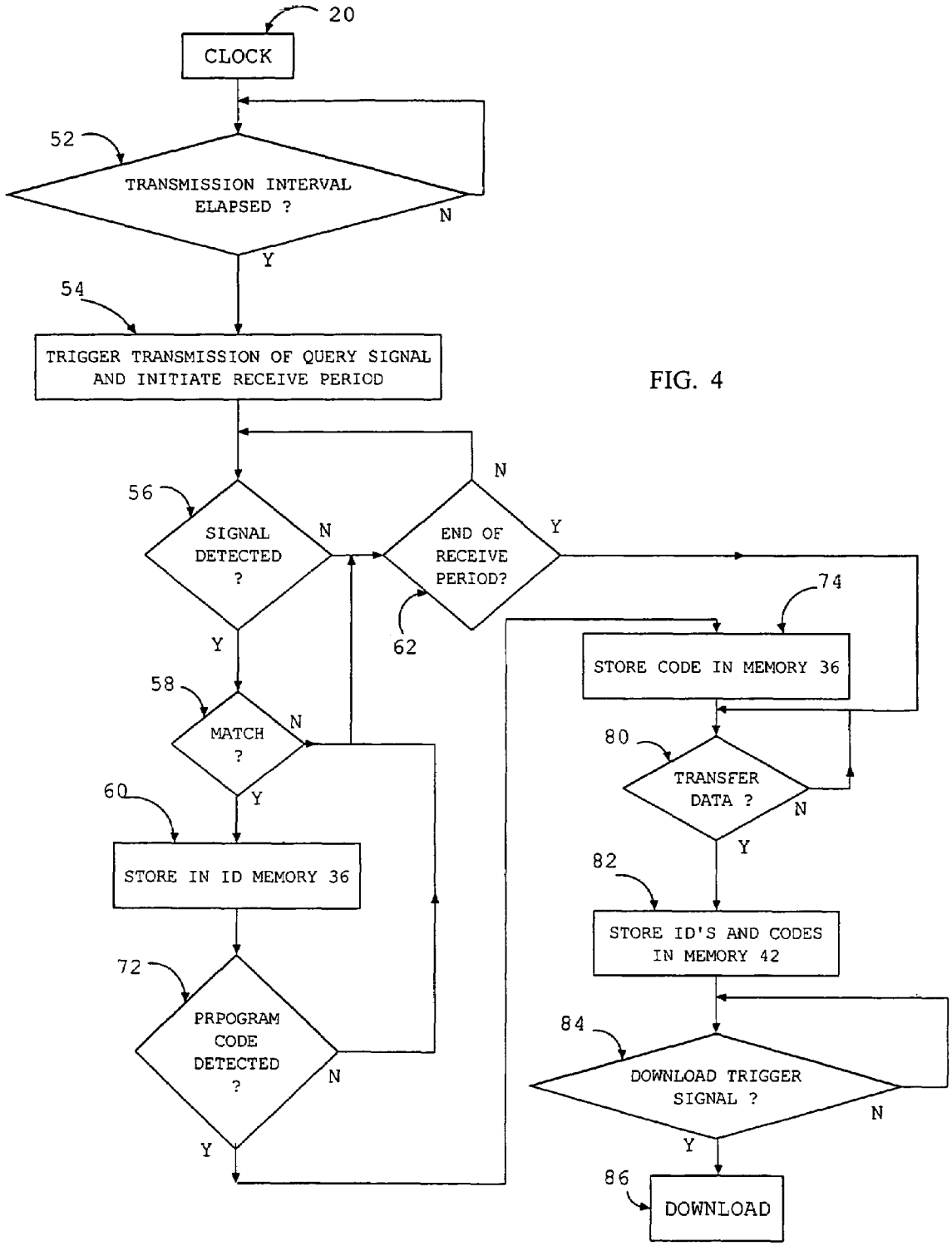
FIG. 4 is a flow chart showing operations performed by the stationary apparatus.
Figure 5:
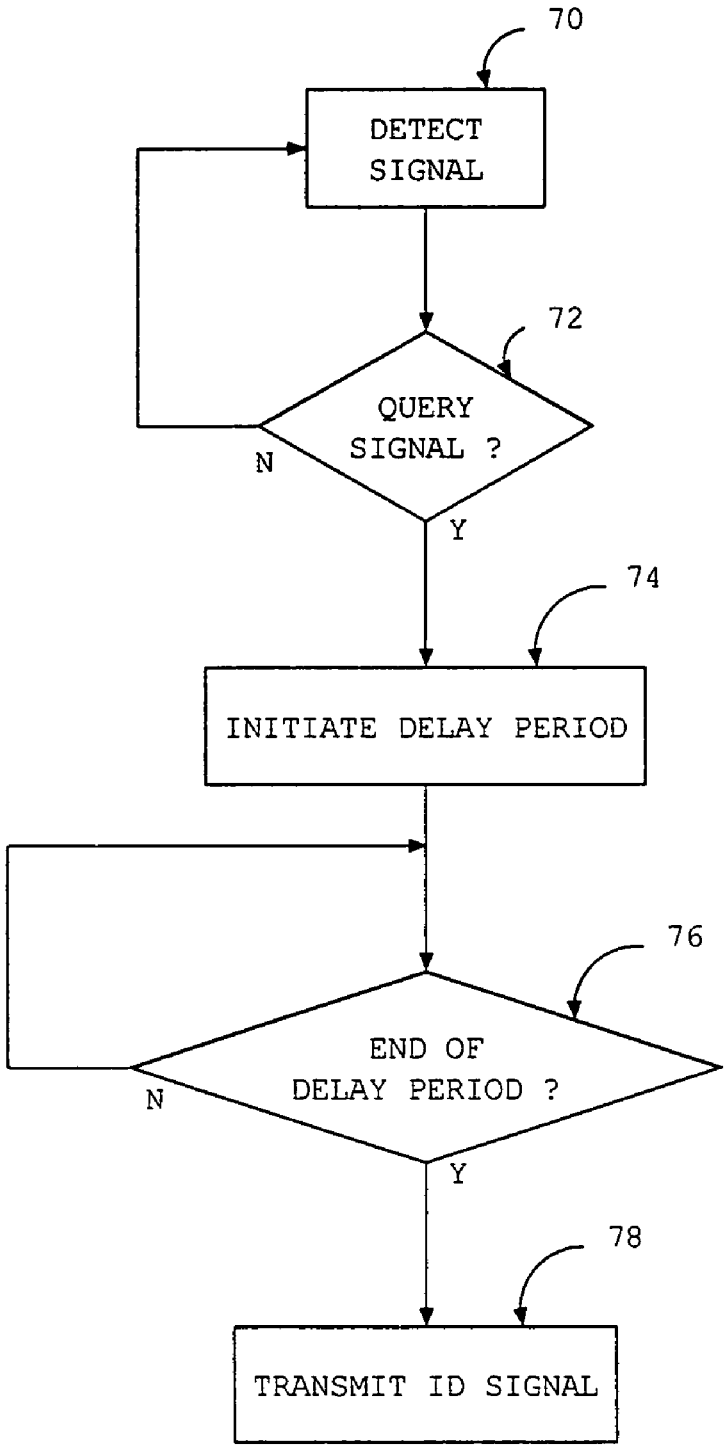
FIG. 5 is a flow chart showing operations performed by the portable device.

Details of stationary apparatus 5 and portable device 7 will now be explained in association with the schematic diagrams of FIGS. 2 and 3, and the flow charts of FIGS. 4 and 5. FIGS. 2 and 3 depict the hardware features of the apparatus, while FIGS. 4 and 5 show the operations performed by the hardware. The operations shown in FIGS. 4 and 5 can be implemented, for example, by a suitable microprocessor receiving input signals and generating control signals responsive thereto. The depictions in FIGS. 2–5 are illustrative, and specific implementations will be readily apparent to anyone with ordinary skill in the art.

At preset transmission intervals which are actuated by clock 20, transmitter 22 will emit a query signal 24. See also 52 and 54 in FIG. 4. The nature of this query signal is a matter of engineering choice and can be, for example, acoustic, radio or infra red. Detector 26 in portable device 7 is designed to detect query signal 24 and identify it as that particular signal. Thus, as shown in FIG. 5, detector 26 will detect the signal, as at 70. A determination is then made at 72 whether the detected signal is the query signal and, if so, the above-mentioned delay period will be initiated at 74 and performed by delay circuit 27 (FIG. 3). When the end of the delay period is reached, as determined at 76, transmitter 28 of portable device 7 will transmit the pre-stored ID signal, as at 78, from memory 29. Thus, each of portable devices 7 within range of transmitter 22 (i.e. worn by those persons within the reception location and thus forming the audience in attendance) will react to query signal 24 by transmitting its unique ID signal. However, since the delay period of each portable device 7 is unique, as mentioned above, this transmission of ID signals by the plurality of portable devices in the room will be staggered so that no ID signal "steps on" another.

The ID signals from the respective transmitters 28 of portable devices 7 are received by detector 30 of stationary apparatus 5 within a receive period initiated by operation 54 (see below). Operation 56 in FIG. 2 determines whether a signal has been detected by detector 30. If such a signal has been detected, then comparator 32 performs a matching test, as at 58, to determine whether the detected signal matches any of the pre-stored ID's in memory 34. If a match is found, then operation 60 stores the detected ID signal in memory 36.

If it is determined at 56 that no signal has been detected, or at 58 that a detected signal does not match any of the pre-stored ID's, then a determination is made at 62 whether the end of the receive period has been reached. The duration of this receive period is set such that it is somewhat longer than the longest delay period of any of the portable devices. This enables the proper reception and processing of the ID signals from all of the portable devices 7. If the end of the receive period has not been reached, then the flow is redirected to the signal detection 56. However, if the end of the receive period has been reached, then this phase of the operation is ended, and this can be used to trigger data transfer 80, as described below.

Up to this point, a description has been provided which results in determining the specific identity of the audience members who are then in attendance within the reception location. Those identities are stored in memory 36. The frequency with which this determination is made is a matter of engineering choice depending on the memory capacity to be made available for this task versus the perceived importance of the need to have the most updated information regarding the audience. Thus, if the duration of the transmission interval for query signal 24 is selected to be one minute, for example, accurate data will be available promptly after any member of the audience leaves the room. However, this comes at the cost of requiring a higher memory capacity than would be needed, for example, if such duration were to be selected at 15 minutes.

The above-described surveying codes from broadcast signal 2 are re-transmitted by code retransmission source 3 are received by code detector 40 of stationary apparatus 5, as 72 (FIG. 4). Details of such a code detector 40 and operation 72 are provided in the above-mentioned patents of the present inventor. Such details found therein are hereby incorporated herein by reference. Each detected surveying code is outputted from code detector 40 to be stored in memory 36, as at 74 (FIG. 4). Thus, for any given measurement period, as explained below, memory 36 has stored therein a combination of the ID's for all the audience members who are currently in attendance together with the surveying codes for the particular program being viewed by that audience during such time period. The output of clock 20 can also be used to time stamp the stored ID's and/or the stored surveying codes. This arrangement of storing the ID signals with the surveying codes received within the measurement period enables the association of a program segment (as identifiable from the surveying code) with the audience then in attendance (as identifiable from the ID's). The provision of a time stamp can serve to gain additional information which may be of value.

Memory 36 is of relatively low capacity and is used for short term storage of data. It is desirable to transfer information from such short term memory into a long term memory. That long term storage function is performed by memory 42. The transfer of information from memory 36 to memory 42 is triggered by data transfer control circuit 41 based on any one of the following events which define the termination of a measurement period. Firstly, such transfer can be triggered by each detection of a surveying code received from code detector 40. Secondly, such transfer can be triggered by termination of the receive period for the ID signals. Thus, each time all of the ID signals from the portable devices 7 are detected responsive to the query signal, such data together with the stored surveying codes will be transferred to memory 42. Thirdly, clock 20 can be used to actuate such transfer at predetermined measurement intervals. The measurement period is determined based on the length of a program segment for which survey data is of interest. A finer measurement can be obtained by reducing the measurement period to limit the stored data to a program segment duration of interest, and vice versa. It is also possible to use the clock for controlling the storage of data at only a predetermined program segment, as opposed to doing so at repeated intervals. Data transfer control circuitry 41 in FIG. 2 performs the above-described operations that are also illustrated at 80 and 82 in FIG. 4.

Once information has been stored in long term memory 42, it is necessary to download such information to the central processing station 50. Download control circuitry 44 is provided for such purpose, and its function is illustrated by 84 in FIG. 4. The download control trigger signal 45 can be generated at preset intervals or at a preset time of day by clock 20, at any time by the manual operation of depressing a key, and/or by a remote trigger signal 90 provided, for example, from the central processing station on communications link 88. When the download control 44 produces its output control trigger signal 45, suitable download apparatus 46, such as a modem, will proceed to effect the transmission of data via communications link 88 from memory 42 to the central processing station 50, as at 86 (FIG. 4). The details of how this is implemented are well known and, thus, need not be described herein.

One enhancement of the above-described arrangement is to enable the entry of data into stationary apparatus 5 from central processing station 50, as via communications link 88. This remote entry can be used, for example, to conveniently load the pre-stored ID's into memory 34. It can also be used to pre-store surveying codes into code detector 40 for use in detecting the codes of interest. Various other settable parameters stored in stationary apparatus 5 and/or portable devices 7 (possibly via a suitable docking device on apparatus 5, not shown) can be set in this manner to provide added convenience and flexibility as features of the invention.

Use of stationary apparatus 5 provides a number of important improvements in audience surveying. Firstly, its installation into a household of test participants, for example, is fast and easy. Secondly, it is not reliant on battery power. Thirdly, the functions performed by apparatus 5 are such that the portable devices 7 can be relatively simple, as is evident from FIG. 3. Consequently, devices 7 can be light and small, and battery life is comparable to that of a digital watch, for example. Fourthly, it can be provided with any type of storage of any required capacity. For these and other reasons, the level of cooperation by the test participants is much higher than it would be with prior art approaches.

Although a preferred embodiment of the present invention has been described in detail above, various modifications thereto will be readily apparent to anyone with ordinary skill in the art. For example, memories 36 and 42 can be combined. Also, the use of delay circuit 27 can be replaced by other well known means to avoid signal interference among portable devices 7. Furthermore, with the advent and widespread use of the internet, substantially instant download is possible, thus doing away with the need for at least long term memory 42.

A significant variation is elimination of the query signal 24. Instead, portable devices 7 are designed to emit their ID signals at present intervals rather than being triggered to do so by the query signal. This arrangement uses more battery power and shortens battery life, but the difference is relatively slight because emitting ID signal 25 does not require much power.

Also, the trigger signal is transmitted "periodically" at any regular and/or irregular intervals. It is mainly necessary to keep track of such trigger signal transmission so that the identification signals triggered in response thereto are identifiable. For the above-identified embodiment which does not utilize such a trigger signal, the identification signals can also be emitted "periodically" at regular and/or irregular intervals, the key point being that they are detected by the stationary unit.

These and other such modifications are intended to fall within the scope of the present invention as defined by the following claims.

We claim:

1. Apparatus for identifying members of an audience tuned to a program broadcast by a programming signal source, comprising:

stationary means including transmitter means for periodically emitting a query signal and positioned at a reception location with reproduction equipment to perform the program;

a plurality of portable means carried by members of the audience, including first detecting means to detect said query signal and, responsive thereto, emit respective audience-member identification signals, and said stationary means including second detecting means to detect said identification signals;

wherein the broadcast program is transmitted by the programming signal source in combination with a surveying code, and the stationary means further comprises third detecting means for detecting said surveying code and associating said surveying code with said identification signals.

2. The apparatus of claim 1, wherein said third detecting means associates the surveying code which is detected at a given time with the identification signals detected at said given time.

3. The apparatus of claim 2, wherein said stationary means includes means to store said surveying codes.

4. The apparatus of claim 3, wherein said stationary means includes means to store said identification signals.

5. The apparatus of claim 4, wherein the reproduction equipment includes fourth detecting means to detect and retransmit the surveying code, and wherein said third detecting means is adapted to receive such retransmitted surveying code.

6. The apparatus of claim 5, wherein each of said portable means emits a unique identification signal.

7. The apparatus of claim 6, wherein said portable means include means to prevent the identification signals detected by the second detecting means from interfering with each other in being detected by said stationary means.

8. The apparatus of claim 2, further comprising means for setting a time interval during which the surveying codes detected by the third detecting means are associated with the identification signals detected by the second detecting means.

9. The apparatus of claim 8, further comprising a first memory means to store the detected surveying codes with the associated identification signals during said time interval and a second memory for storing data retrieved from the first memory upon termination of the time interval.

10. The apparatus of claim 9, further comprising download means responsive to an actuation signal for transferring data stored in said second memory to a remote processing station.

11. The apparatus of claim 1, wherein the reproduction equipment includes fourth detecting means to detect and retransmit the surveying code, and wherein said third detecting means is adapted to receive such retransmitted surveying code.

12. A method for identifying members of an audience tuned to a program broadcast by a programming signal source, comprising:

storing personal identification data in a plurality of portable devices to be carried by members of the audience;

periodically emitting a trigger signal at a reception location;

transmitting said identification data from the portable devices of audience members in attendance at the reception location in response to said trigger signal; and detecting said transmitted identification data;

wherein the broadcast program is transmitted by the programming signal source in combination with a surveying code, and the method further comprises detecting said surveying code and associating said surveying code with said identification signals.

13. The method of claim 12, wherein the surveying code which is detected at a given time is associated with the identification signals detected at said given time.

14. The method of claim 13, further comprising setting a time interval during which the surveying codes that are detected are associated with the identification signals that are detected.

15. The method of claim 14, further comprising storing the detected surveying codes with the associated identification signals during said time interval in a first memory and storing data retrieved from the first memory in a second memory upon termination of the time interval.

16. Apparatus for identifying members of an audience tuned to a program broadcast by a programming signal source, comprising;

a plurality of portable means carried by members of the audience, including means to periodically emit respective audience-member identification signals, and stationary means positioned at a reception location with reproduction equipment to perform the program, said stationary means including means to detect said identification signals;

wherein the broadcast program is transmitted by the programming signal source in combination with a surveying code, and the stationary means further comprises third detecting means for detecting said surveying code and associating said surveying code with said identification signals.

17. The apparatus of claim 16, wherein said third detecting means associates the surveying code which is detected at a given time with the identification signals detected at said given time.

18. The apparatus of claim 17, wherein said stationary means includes means to store said surveying codes.

19. The apparatus of claim 18, wherein said stationary means includes means to store said identification signals.

20. The apparatus of claim 19, wherein the reproduction equipment includes fourth detecting means to detect and retransmit the surveying code, and wherein said third detecting means is adapted to receive such retransmitted surveying code.

21. The apparatus of claim 20, wherein each of said portable means emits a unique identification signal.

22. The apparatus of claim 21, wherein said portable means include means to prevent the identification signals detected by the second detecting means from interfering with each other in being detected by said stationary means.

23. The apparatus of claim 17, further comprising means for setting a time interval during which the surveying codes detected by the third detecting means are associated with the identification signals detected by the second detecting means.

24. The apparatus of claim 23, further comprising a first memory means to store the detected surveying codes with the associated identification signals during said time interval and a second memory for storing data retrieved from the first memory upon termination of the time interval.

25. The apparatus of claim 24, further comprising download means responsive to an actuation signal for transferring data stored in said second memory to a remote processing station.

26. A method for identifying members of an audience tuned to a program broadcast by a programming signal source, comprising:

storing personal identification signals in a plurality of portable devices to be carried by members of the audience;

periodically transmitting said identification signals from the portable devices; and detecting the identification signals from those of said portable devices that are carried by audience members in attendance at a reception location;

wherein the broadcast program is transmitted by the programming signal source in combination with a surveying code, and the method further comprises detecting said surveying code and associating said surveying code with said identification signals.

27. The method of claim 26, further comprising the step of storing said transmitted identification signals.

28. The method of claim 26, wherein the surveying code which is detected at a given time is associated with the identification signals detected at said given time.

29. The method of claim 28, further comprising setting a time interval during which the surveying codes that are detected are associated with the identification signals that are detected.

30. The method of claim 29, further comprising storing the detected surveying codes with the associated identification signals during said time interval in a first memory and storing data retrieved from the first memory in a second memory upon termination of the time interval.

* * * * *